US011765516B2

(12) United States Patent
Xiao et al.

(10) Patent No.: US 11,765,516 B2
(45) Date of Patent: Sep. 19, 2023

(54) SOUNDING DEVICE

(71) Applicant: AAC Microtech (Changzhou) Co., Ltd., Changzhou (CN)

(72) Inventors: Bo Xiao, Shenzhen (CN); Ronglin Linghu, Shenzhen (CN); Tong Zhang, Shenzhen (CN); Chenliang Kong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 28 days.

(21) Appl. No.: 17/565,476

(22) Filed: Dec. 30, 2021

(65) Prior Publication Data

US 2022/0360904 A1 Nov. 10, 2022

(30) Foreign Application Priority Data

May 6, 2021 (CN) ..... 202120952690.6

(51) Int. Cl.

| | |
|---|---|
| ***H04R 9/06*** | (2006.01) |
| ***H04R 9/04*** | (2006.01) |
| ***H04R 9/02*** | (2006.01) |
| ***H04R 1/02*** | (2006.01) |
| ***H04R 31/00*** | (2006.01) |

(52) U.S. Cl.

CPC ..... *H04R 9/06* (2013.01); *H04R 1/026* (2013.01); *H04R 9/025* (2013.01); *H04R 9/046* (2013.01); *H04R 31/003* (2013.01); *H04R 2400/11* (2013.01)

(58) Field of Classification Search

CPC ..... H04R 9/06; H04R 1/026; H04R 9/025; H04R 9/046; H04R 31/003; H04R 2400/11; H04R 9/027; H04R 9/063; H04R 2499/11; H05K 2201/09263; H05K 2201/1003; H05K 2201/052; H01F 2007/062

USPC ..... 381/396, 400, 401, 409, 150, 412

See application file for complete search history.

(56) References Cited

U.S. PATENT DOCUMENTS

| | | | | |
|---|---|---|---|---|
| 10,250,989 | B1 * | 4/2019 | Xiao | H04R 23/008 |
| 2020/0213761 | A1 * | 7/2020 | Xiao | H04R 7/04 |

FOREIGN PATENT DOCUMENTS

| | | | | |
|---|---|---|---|---|
| CN | 209526874 U | * 10/2019 | ..... | H04R 1/06 |

* cited by examiner

*Primary Examiner* — Paul C McCord
*Assistant Examiner* — Julie X Dang
(74) *Attorney, Agent, or Firm* — W&G Law Group

(57) ABSTRACT

Provided is a sounding device, including frame and vibration system and magnetic circuit unit fixed to the frame. The vibration system includes diaphragm, voice coil driving the diaphragm to vibrate and sound, holder fixed to diaphragm, and auxiliary diaphragm spaced from diaphragm. The holder includes holder main body, first connection portion formed from holder main body to magnetic circuit unit and second connection portion spaced from first connection portion. The voice coil is fixed to second connection portion. One end of the auxiliary diaphragm is fixed to frame. One end of first connection portion away from holder main body bends and extends away from second connection portion to form flange. One end of auxiliary diaphragm away from frame is fixed to flange. The sounding device may reduce accuracy deviation and hidden dangers of gluing failure caused by rear assembling of the auxiliary diaphragm.

9 Claims, 11 Drawing Sheets

SOUNDING DEVICE

TECHNICAL FIELD

The present disclosure relates to the field of acoustoelectric technologies, and in particular, to a sounding device applied to portable electronic products.

BACKGROUND

With the advent of the Internet era, the number of mobile terminal devices continues to rise. Among mobile devices, mobile phones are undoubtedly the most common and portable mobile terminal devices. At present, the mobile phones have extremely diverse functions, one of which is the high-quality music play function. Therefore, sounding devices configured to sound are widely used in today's smart mobile devices.

In the related art, the sounding device includes a frame and a vibration system and a magnetic circuit unit respectively fixed to the frame. The vibration system includes a diaphragm, a voice coil driving the diaphragm to vibrate and sound, a holder fixed to the diaphragm, and an auxiliary diaphragm spaced from the diaphragm. The holder includes a holder main body, a first connection portion formed by extending from the holder main body to the magnetic circuit unit and a second connection portion. The voice coil is fixed to the second connection portion. The auxiliary diaphragm has one end fixed to the frame and the other end fixed to the first connection portion. However, rear assembly of the auxiliary diaphragm (i.e., one end of the auxiliary diaphragm away from the frame is glued to the first connection portion) of the sounding device easily leads to deviation of assembly accuracy and hidden dangers of gluing failure.

Therefore, there is a need to provide a new sounding device to solve the above technical problem.

SUMMARY

An objective of the present disclosure is to provide a sounding device that may reduce accuracy deviation and hidden dangers of gluing failure caused by rear assembly of the auxiliary diaphragm.

In order to achieve the above objective, the present disclosure provides a sounding device, including a frame and a vibration system and a magnetic circuit unit respectively fixed to the frame. The vibration system includes a diaphragm, a voice coil driving the diaphragm to vibrate and sound, a holder fixed to the diaphragm, and an auxiliary diaphragm spaced from the diaphragm. The holder includes a holder main body, a first connection portion formed by extending from the holder main body to the magnetic circuit unit, and a second connection portion spaced from the first connection portion. The voice coil is fixed to the second connection portion. One end of the auxiliary diaphragm being fixed to the frame. One end of the first connection portion away from the holder main body bends and extends toward a direction departing from the second connection portion to form a flange. One end of the auxiliary diaphragm away from the frame is fixed to the flange.

As an improvement, the auxiliary diaphragm includes a first fixed portion fixed on the frame, a second fixed portion spaced from the first fixed portion, and a suspension portion connecting the first fixed portion and the second fixed portion. The flange is fixed to the second fixed portion.

As an improvement, the flange is embedded in the second fixed portion.

As an improvement, the second fixed portion is fixed to one of two opposite sides of the flange along a vibrating direction of the diaphragm.

As an improvement, the diaphragm includes a first diaphragm body and a second diaphragm body arranged around the first diaphragm body. An outer periphery of the second diaphragm body is fixed to the frame. An inner periphery of the second diaphragm body is fixed to the holder main body. An outer periphery of the first diaphragm body is fixedly connected to the holder main body and the second connection portion.

As an improvement, the second connection portion includes a first part fixedly connected to the voice coil and a second part connecting the first part and the holder main body. The first part and the second part are enclosed to form a groove. The outer periphery of the first diaphragm body includes a third part fixed to the holder main body and a fourth part fixed to the first part and the second part and filling the groove.

As an improvement, the holder main body is in a shape of a ring. The first connection portion is formed by extending from an outer periphery of the holder main body, and the second connection portion is formed by extending from an inner periphery of the holder main body.

As an improvement, the first diaphragm body has a hollow portion. The magnetic circuit unit includes a yoke, a main magnet portion fixed to the yoke and an auxiliary magnet portion fixed on one side of the main magnet portion away from the yoke. The auxiliary magnet portion includes a base portion fixed to the main magnet portion and a boss formed by extending from the base portion to a direction away from the main magnet portion. An orthographic projection of the boss on the base portion is within a range of the base portion. An inner periphery of the first diaphragm body surrounds the boss and is fixed to the base portion.

As an improvement, the vibration system further includes a flexible printed circuit board having a retaining portion fixed to the first fixed portion, a bonding portion connected to the second fixed portion, and an elastic arm connecting the retaining portion and the bonding portion. An opening of the suspension portion is oriented toward the flexible printed circuit board. An orthographic projection of the elastic arm on the auxiliary diaphragm is within a range of the suspension portion.

As an improvement, the flexible printed circuit board further includes a bending portion formed by bending and extending from the bonding portion to the diaphragm and a first pad portion formed by bending and extending from the bending portion to a direction departing from the bonding portion. The holder main body is provided with a window, and the first pad portion extends into the window and is electrically connected to the voice coil.

Compared with the related art, in the sounding device according to the present disclosure, one end of the first connection portion away from the holder main body is provided with a flange formed by bending and extension toward a direction departing from the second connection portion, and one end of the auxiliary diaphragm away from the frame is fixed to the flange, so as to reduce accuracy deviation and hidden dangers of gluing failure caused by rear assembly of the auxiliary diaphragm.

BRIEF DESCRIPTION OF DRAWINGS

In order to more clearly illustrate the technical solutions in embodiments of the present disclosure, the accompanying drawings used in the description of the embodiments will be briefly introduced below. It is apparent that, the accompanying drawings in the following description are only some embodiments of the present disclosure, and other drawings can be obtained by those of ordinary skill in the art from the structures shown in the provided drawings without creative efforts.

DESCRIPTION OF EMBODIMENTS

The technical solutions in embodiments of the present disclosure will be described clearly and completely below with reference to the accompanying drawings in the embodiments of the present disclosure. It is appreciated that, the described embodiments are merely some of rather than all of the embodiments of the present disclosure. All other embodiments acquired by those skilled in the art without creative efforts based on the embodiments of the present disclosure shall fall within the protection scope of the present disclosure.

Referring to FIG. 1 to FIG. 11 together, a sounding device includes a frame 1 and a vibration system 3 and a magnetic circuit unit 5 respectively fixed to the frame 1. The magnetic circuit unit 5 is configured to drive the vibration system 3 to vibrate and sound.

Figure 1:
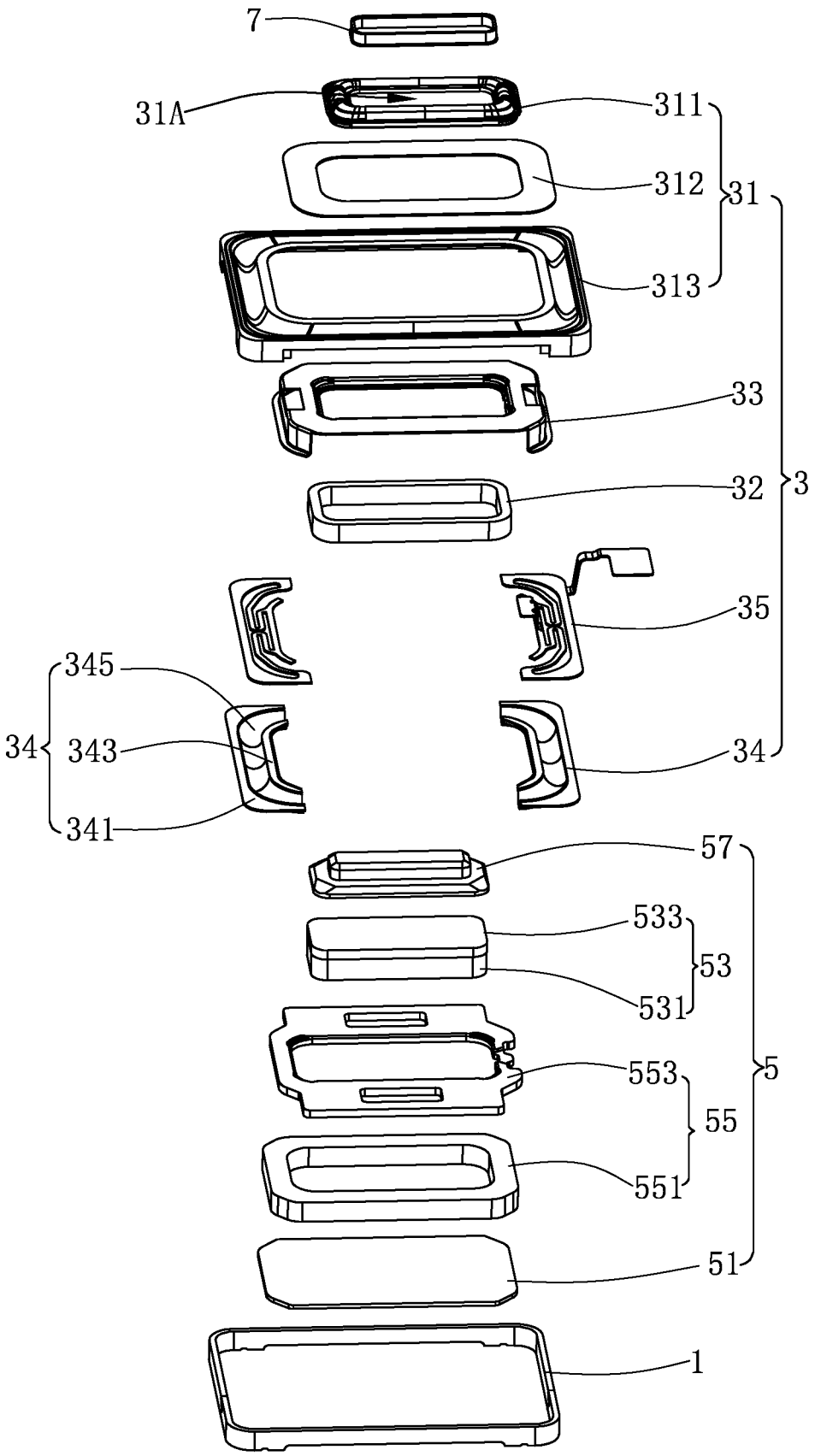
FIG. 1 is an exploded view of an embodiment of a sounding device according to the present disclosure.
Figure 2:
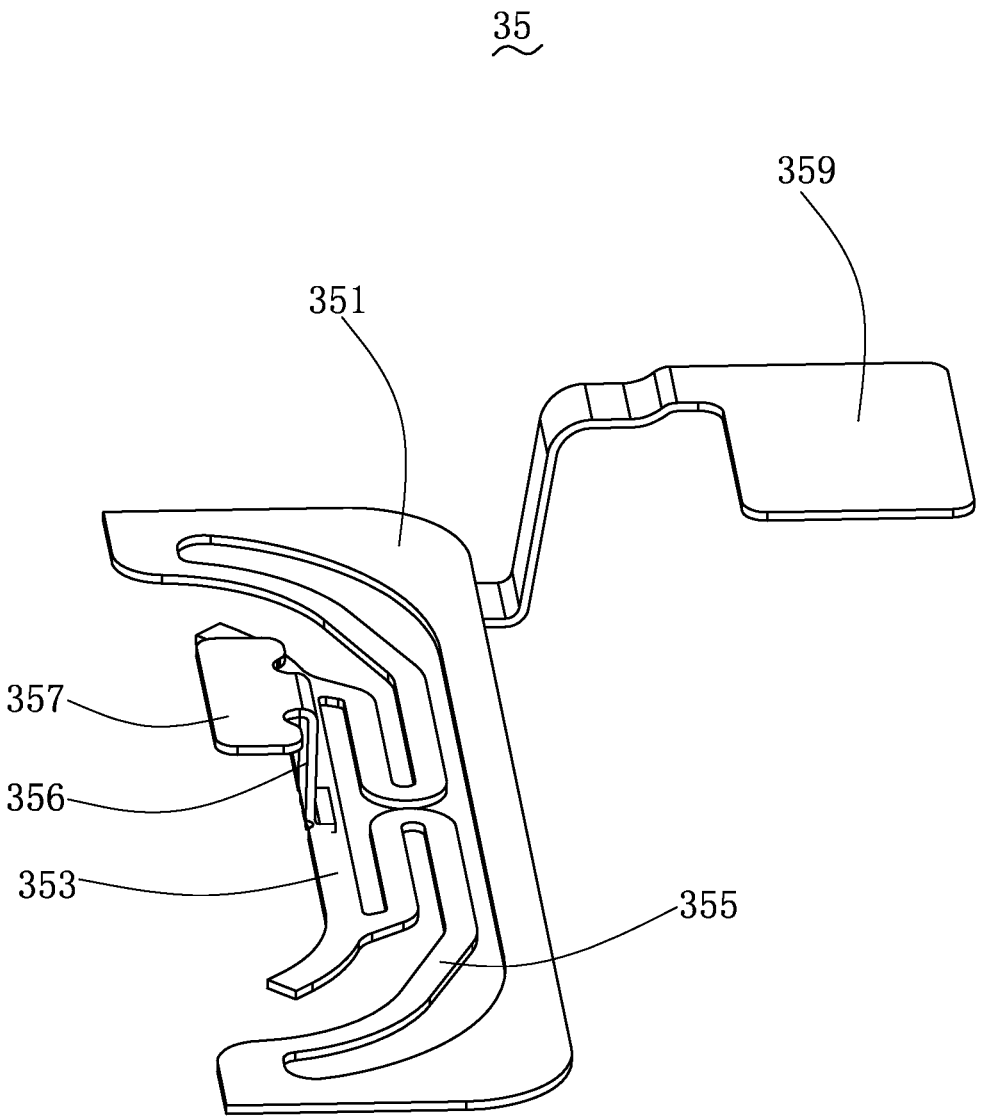
FIG. 2 is a schematic structural diagram of a flexible printed circuit board in the sounding device shown in FIG. 1.
Figure 3:
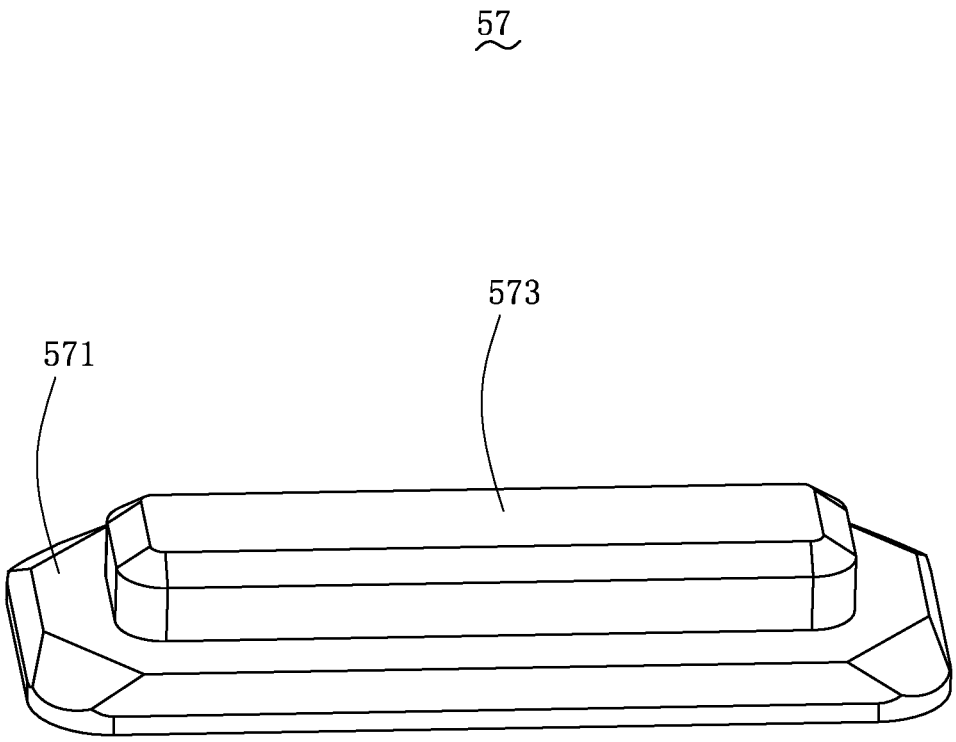
FIG. 3 is a schematic structural diagram of an auxiliary magnet portion in the sounding device shown in FIG. 1.
Figure 4:
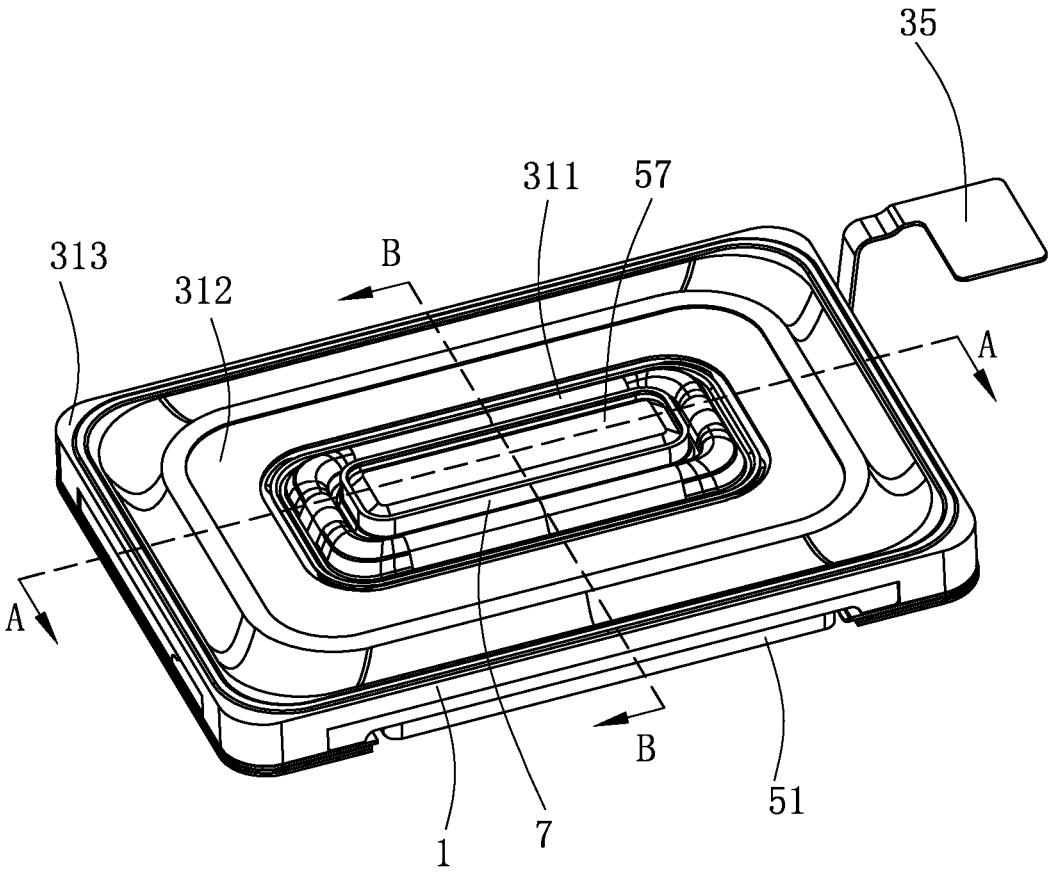
FIG. 4 is a schematic structural diagram of the sounding device shown in FIG. 1 after assembling.
Figure 5:
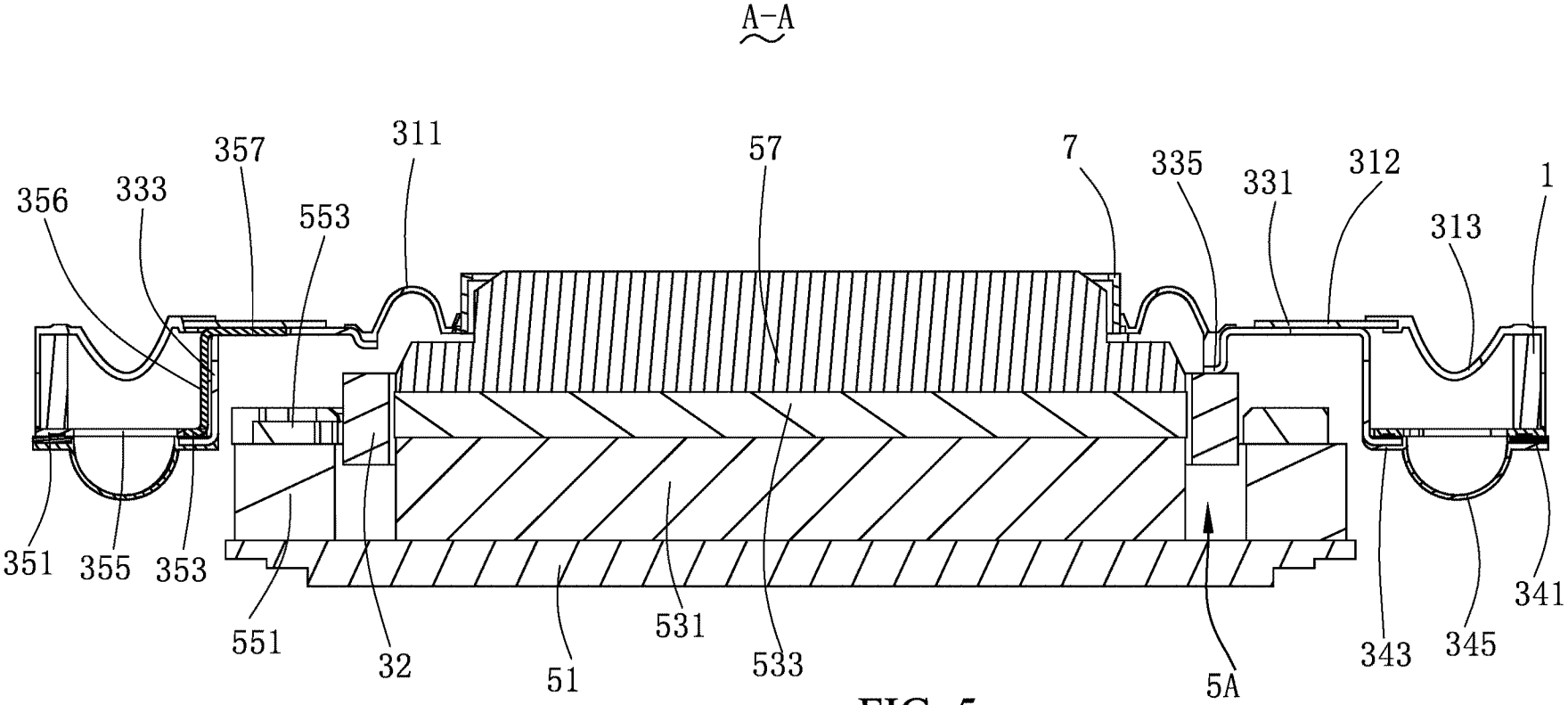
FIG. 5 is a sectional view of the sounding device shown in FIG. 4 taken along a direction A-A.

The vibration system 3 includes a diaphragm 31 fixed on the frame 1, a voice coil 32 driving the diaphragm 31 to vibrate and sound, a holder 33 and an auxiliary diaphragm 34 spaced from the diaphragm 31. The holder 33 is connected to the voice coil 32, the diaphragm 31 and the auxiliary diaphragm 34. The voice coil 32 is electrically connected to an external circuit. After the voice coil 32 is energized, the voice coil 32 vibrates under the action of a magnetic field of the magnetic circuit unit 5. At the same time, the voice coil 32 drives the diaphragm 31, the holder 33 and the auxiliary diaphragm 34 to vibrate together, and thus the diaphragm 31 and the auxiliary diaphragm 34 vibrate and sound. As shown in FIG. 1 and FIG. 5, two auxiliary diaphragms 34 are provided, and the two auxiliary diaphragms 34 are spaced along a major-axis direction of the sounding device.

The holder 33 includes a holder main body 331, a first connection portion 333 formed by extending from the holder main body 331 to the magnetic circuit unit 5, and a second connection portion 335 spaced from the first connection portion 333. One end of the auxiliary diaphragm 34 is fixed to the frame 1. The voice coil 32 is fixed to the second connection portion 335. One end of the first connection portion 333 away from the holder main body 331 bends and extends toward a direction departing from the second connection portion 335 to form a flange 334, and one end of the auxiliary diaphragm 34 away from the frame 1 is fixed to the flange 334.

As shown in FIG. 1 and FIG. 5, the holder main body 331 has a ring shape, the first connection portion 333 is formed by extending from an outer periphery of the holder main body 331, and the second connection portion 335 is formed by extending from an inner periphery of the holder main body 331.

In one embodiment, the second connection portion 335 is formed by stamping from the holder main body 331.

The auxiliary diaphragm 34 includes a first fixed portion 341 fixed on the frame 1, a second fixed portion 343 spaced from the first fixed portion 341 and fixed to the first connection portion 333, and a suspension portion 345 connecting the first fixed portion 341 and the second fixed portion 343. The flange 334 is fixed to the second fixed portion 343. The flange 334 and the second fixed portion 343 may also be fixed in any one of the following manners.

Figure 9:
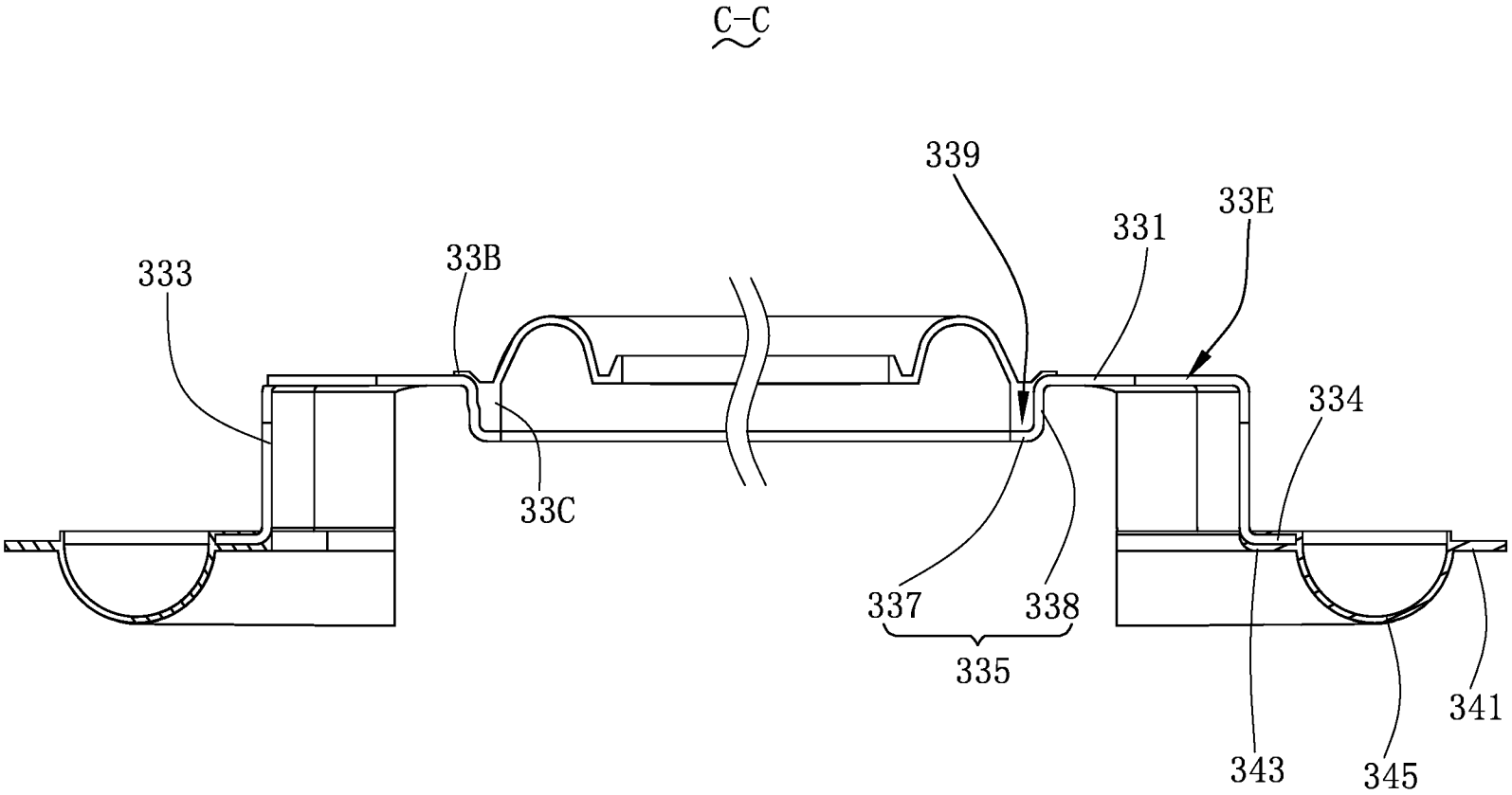
FIG. 9 is a sectional view of an assembled structure of the auxiliary diaphragm, the holder and the first diaphragm body shown in FIG. 8 taken along a direction C-C.

As shown in FIG. 9, the flange 334 is embedded in the second fixed portion 343.

Figure 10:
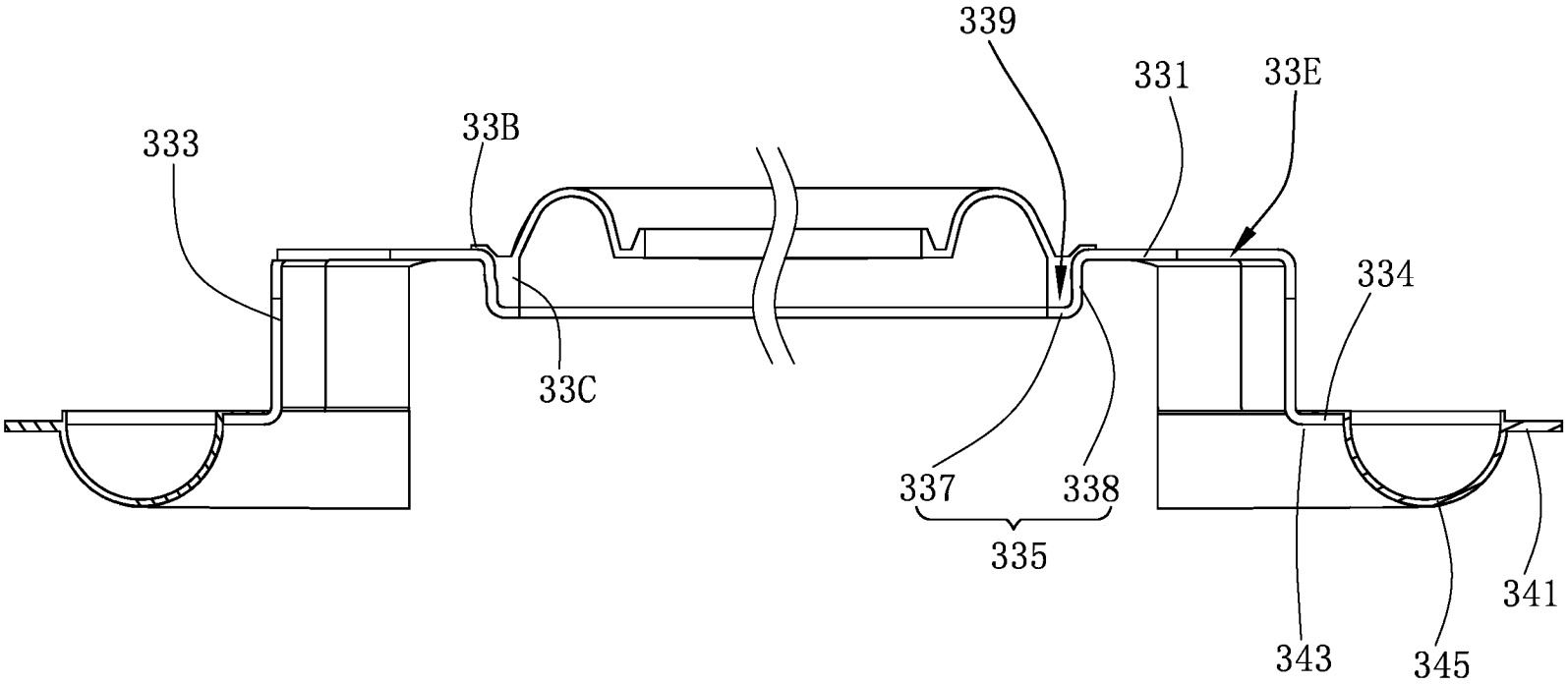
FIG. 10 is a schematic structural diagram of another embodiment of the sounding device according to the present disclosure after the auxiliary diaphragm, the holder and the first diaphragm body are assembled.

As shown in FIG. 10, the second fixed portion 343 is fixed to one side of the flange 334 toward the diaphragm 31. That is, the second fixed portion 343 is fixed to one of two opposite sides of the flange 334 along a vibrating direction of the diaphragm 31.

Figure 11:
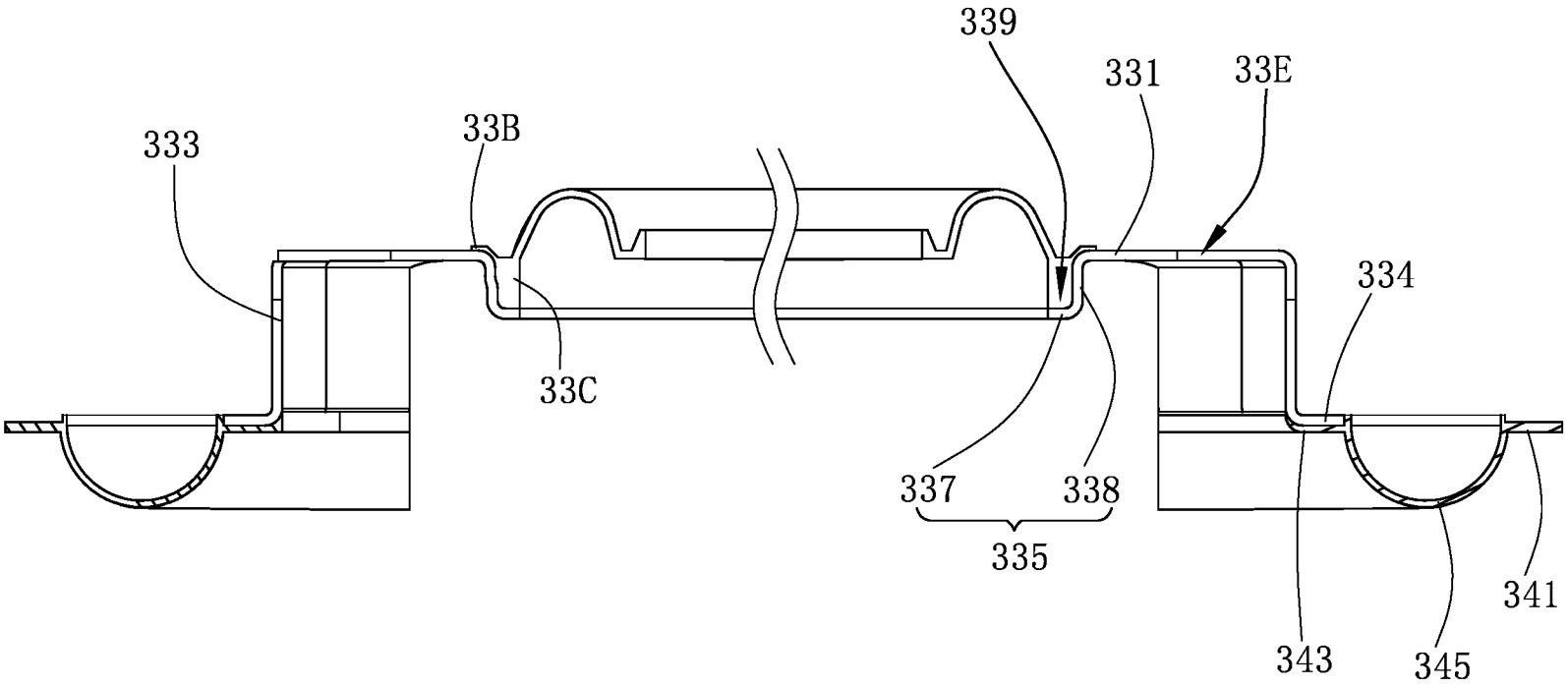
FIG. 11 is a schematic structural diagram of still another embodiment of the sounding device according to the present disclosure after the auxiliary diaphragm, the holder and the first diaphragm body are assembled.

As shown in FIG. 11, the second fixed portion 343 is fixed to one side of the flange 334 departing from the diaphragm 31. That is, the second fixed portion 343 is fixed to the other of the two opposite sides of the flange 334 along the vibrating direction of the diaphragm 31.

The diaphragm 31 includes a first diaphragm body 311 and a second diaphragm body 313 arranged around the first diaphragm body 311. An inner periphery of the second diaphragm body 313 is fixed to the holder main body 331. An outer periphery of the second diaphragm body 313 is fixed on the frame 1 to fixedly arrange the diaphragm 31 on the frame 1. An outer periphery of the first diaphragm body 311 is fixedly connected to the holder main body 331 and the second connection portion 335. An opening of the suspension portion 345 is arranged opposite to an opening of the second diaphragm body 313.

Figure 6:
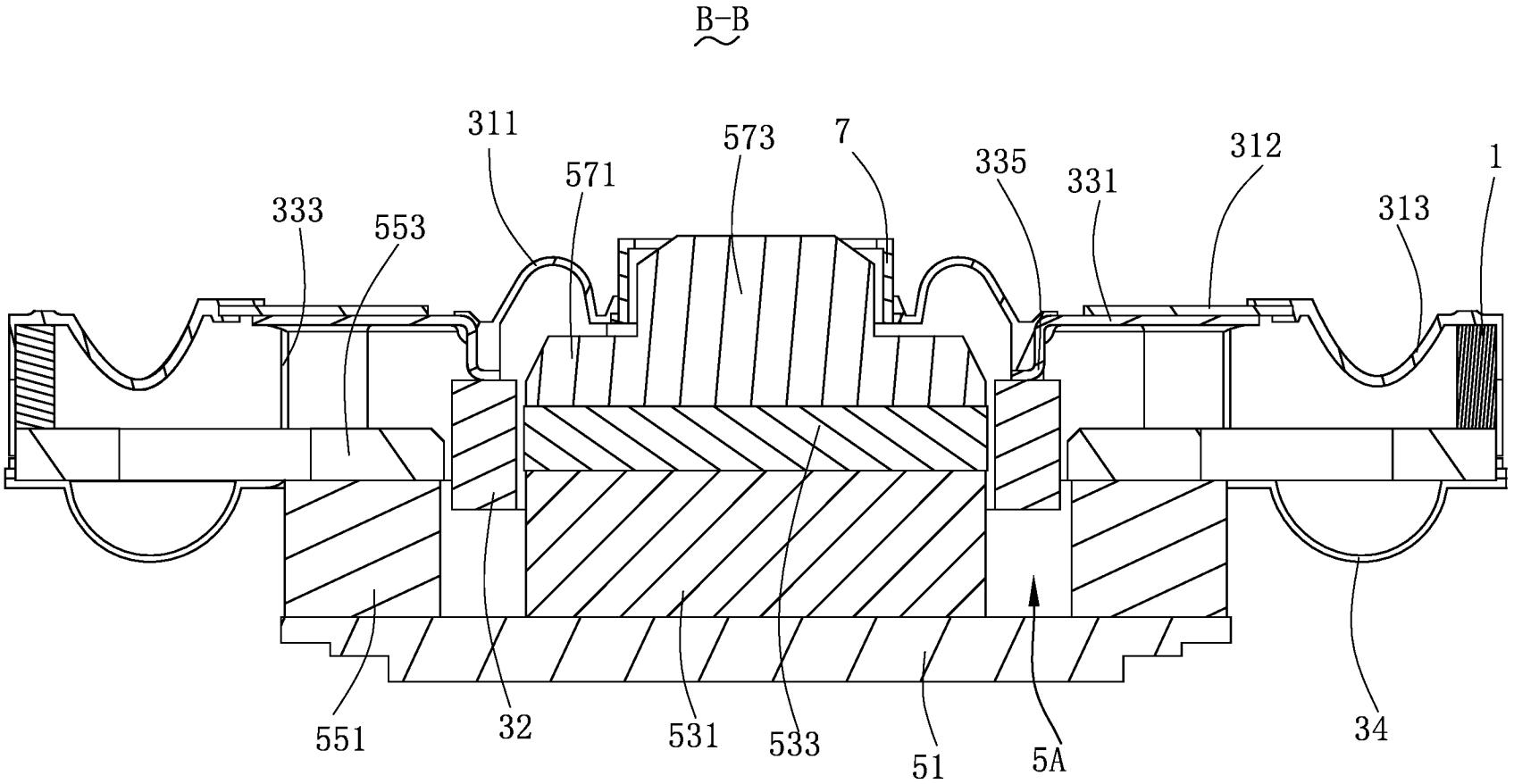
FIG. 6 is a sectional view of the sounding device shown in FIG. 4 taken along a direction B-B.
Figure 7:
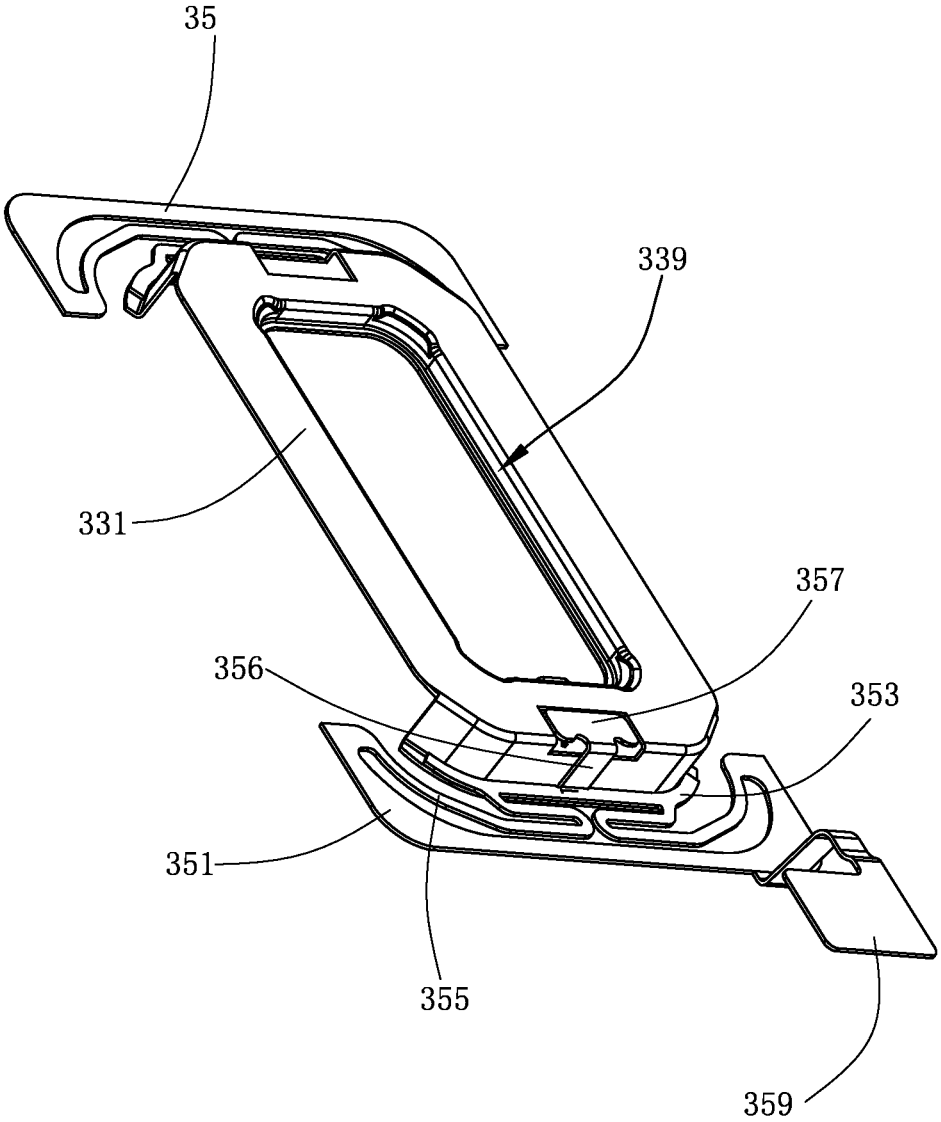
FIG. 7 is a schematic structural diagram of the sounding device shown in FIG. 1 after a holder and the flexible printed circuit board are assembled.
Figure 8:
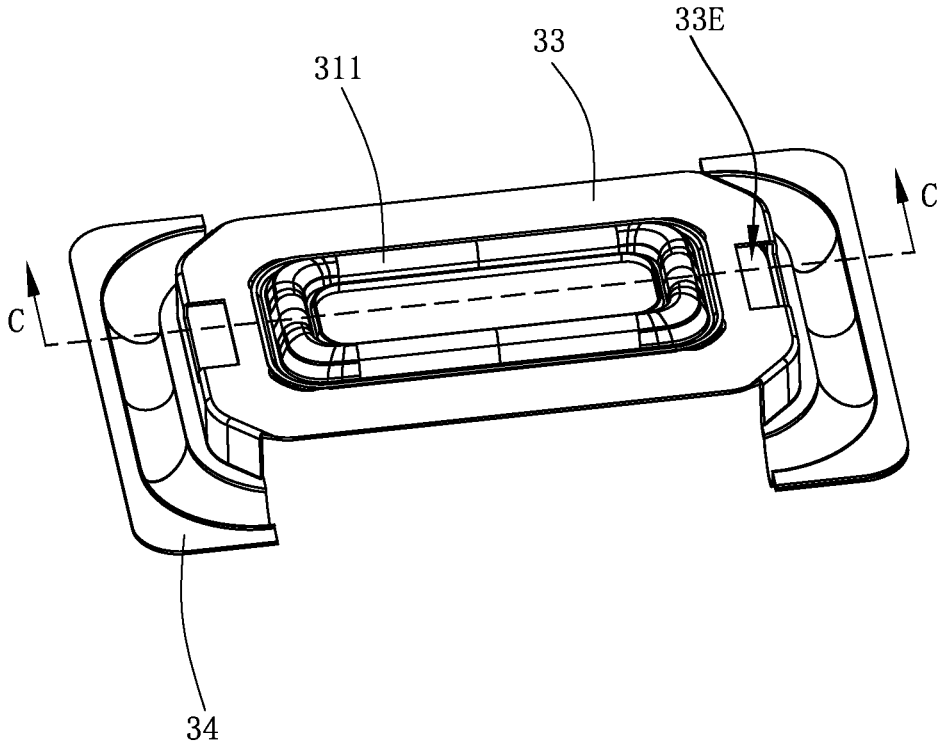
FIG. 8 is a schematic structural diagram of the sounding device shown in FIG. 1 after an auxiliary diaphragm, the holder and a first diaphragm body are assembled.

In one embodiment, the diaphragm 31 further includes a dome 312 arranged around the first diaphragm body 311 and fixed on the holder main body 331. An outer periphery of the dome 312 is embedded in the inner periphery of the second diaphragm body 313. That is, as shown in FIG. 5 and FIG. 6, the inner periphery of the second diaphragm body 313 is indirectly fixed on the holder main body 331 through the dome 312. It may be understood that, in other embodiments, the inner periphery of the second diaphragm body 313 may also be directly fixed on the holder main body 331. That is, the diaphragm 31 may not include the dome.

In one embodiment, the first diaphragm body 311 has a hollow portion 31A, and an inner periphery of the first diaphragm body 311 is fixed to the magnetic circuit unit 5.

In one embodiment, the second connection portion 335 includes a first part 337 fixedly connected to the voice coil 32 and a second part 338 connecting the first part 337 and the holder main body 331. The first part 337 and the second part 338 are enclosed to form a groove 339. The outer periphery of the first diaphragm body 331 includes a third part 33B fixed to the holder main body 331 and a fourth part 33C fixed to the first part 337 and the second part 338 and filling the groove 339. The holder and the first diaphragm body are arranged in such a manner that the accuracy of assembling between the first diaphragm body and the holder may be improved and hidden dangers of failure of gluing between the holder and the first diaphragm body in the related art may be reduced.

The vibration system 3 further includes a flexible printed circuit board 35. The flexible printed circuit board 35 and the auxiliary diaphragm 34 are stacked along the vibrating direction of the diaphragm 31. In one embodiment, the flexible printed circuit board 35 may be arranged between the auxiliary diaphragm 34 and the diaphragm 31, or the flexible printed circuit board 35 is arranged on one side of the auxiliary diaphragm 34 away from the diaphragm 31. In one embodiment, the flexible printed circuit board 35 may be arranged between the auxiliary diaphragm 34 and the diaphragm 31, which is conducive to reducing the overall thickness of the sounding device when the opening of the suspension portion 345 is arranged opposite to the opening of the second diaphragm body 313.

The flexible printed circuit board 35 includes a retaining portion 351 fixed to the first fixed portion 341, a bonding portion 353 connected to the second fixed portion 343 and an elastic arm 355 connecting the retaining portion 351 and the bonding portion 353. An opening of the suspension portion 345 is oriented toward the flexible printed circuit board 35. An orthographic projection of the elastic arm 355 on the auxiliary diaphragm 34 is within a range of the suspension portion 345.

The flexible printed circuit board 35 further includes a bending portion 356 formed by bending and extending from the bonding portion 353 to the diaphragm 31, a first pad portion 357 formed by bending and extending from the bending portion 356 to a direction departing from the bonding portion 353, and a second pad portion 359 extending from the retaining portion 351 to exterior of the sounding device. The holder main body 331 is provided with a window 33E, and the first pad portion 357 extends into the window 33E. On the one hand, the flexible printed circuit board 35 has functions of supporting and fixing the vibration system 3. On the other hand, the first pad portion 357 and the second pad portion 359 are both provided with pads (not shown), and the bending portion 356, the elastic arm 355, the bonding portion 353 and the retaining portion 351 are provided with conductive paths to electrically connect the pads on the first pad portion 357 and the second pad portion 359. The pad on the first pad portion 357 is connected to a lead wire of the voice coil 32 to electrically connect the voice coil 32 (i.e., the first pad portion 357 is electrically connected to the voice coil 32), and the pad on the second pad portion 359 is electrically connected to the external circuit, so that the voice coil 32 is electrically connected to the external circuit through the flexible printed circuit board 35. When the sounding device is operating, an electrical signal of the external circuit is transmitted to the voice coil 32 through the flexible printed circuit board 35. It may be understood that, in other embodiments, the flexible printed circuit board 35 may not include the second pad portion, and correspondingly, the retaining portion 351 is provided with a pad electrically connected to the external circuit.

The magnetic circuit unit 5 includes a yoke 51, a main magnet portion 53 and a secondary magnet portion 55 that are fixed on the yoke 51, and an auxiliary magnet portion 57 fixed on one side of the main magnet portion 53 away from the yoke 51. The secondary magnet portion 55 surrounds the main magnet portion 53 and is spaced from the main magnet portion 53 to form a magnetic gap 5A. The voice coil 32 is inserted into the magnetic gap 5A.

The main magnet portion 53 includes a main magnet 531 fixed on the yoke 51 and a main pole plate 533 sandwiched between the main magnet 531 and the auxiliary magnet portion 57.

The secondary magnet portion 55 includes a secondary magnet 551 fixed on the yoke 51 and a clamping plate 553 fixed on the secondary magnet 551 away from the yoke 51.

As shown in FIG. 1, the secondary magnet 551 is of a ring-shaped structure. It may be understood that, in other embodiments, four secondary magnets may also be provided, which are two first secondary magnets spaced along a minor-axis side of the main magnet 531 and two second secondary magnets spaced along a major-axis side of the main magnet 531, respectively.

The auxiliary magnet portion 57 includes only auxiliary magnets. The auxiliary magnet portion 57 includes a base portion 571 fixed to the main magnet portion 53 and a boss 573 formed by extending from the base portion 571 to a direction away from the main magnet portion 53. An orthographic projection of the boss 573 on the base portion 571 is within a range of the base portion 571. The inner periphery of the first diaphragm body 311 surrounds the boss 573 and is fixed to the base portion 571.

The boss 573 is sleeved with a positioning frame 7. One end of the positioning frame 7 is embedded in the inner periphery of the first diaphragm body 311. During assembling, the positioning frame 7 may realize positioning of the assembly between the magnetic circuit unit 5 and the vibration system 3, thereby improving the accuracy of assembling.

The main magnet 531, the secondary magnet 551 and the auxiliary magnet are all magnets. It may be understood that the main magnet 531, the secondary magnet 551 and the auxiliary magnet may also be natural magnets.

The yoke 51, the clamping plate 553 and the main pole plate 533 are made of magnetically conductive materials. Magnetic flux within the magnetic gap 5A can be effectively increased by magnetic conduction of the yoke 51, the clamping plate 553 and the main pole plate 533, thereby improving the sensitivity of the sounding device.

The above are only embodiments of the present disclosure. It should be pointed out that those of ordinary skill in the art may also make improvements without departing from the ideas of the present disclosure, all of which fall within the protection scope of the present disclosure.

What is claimed is:

1. A sounding device, comprising a frame and a vibration system and a magnetic circuit unit respectively fixed to the frame, the vibration system comprising a diaphragm, a voice coil driving the diaphragm to vibrate and sound, a holder fixed to the diaphragm, and an auxiliary diaphragm spaced from the diaphragm, the holder comprising a holder main body, a first connection portion formed by extending from the holder main body to the magnetic circuit unit, and a second connection portion spaced from the first connection portion, the voice coil being fixed to the second connection portion, one end of the auxiliary diaphragm being fixed to the frame, wherein one end of the first connection portion away from the holder main body bends and extends toward a direction departing from the second connection portion to form a flange, and one end of the auxiliary diaphragm away from the frame is fixed to the flange;

wherein the holder main body is in a shape of a ring, the first connection portion is formed by extending from an outer periphery of the holder main body, and the second connection portion is formed by extending from an inner periphery of the holder main body.

2. The sounding device as described in claim 1, wherein the auxiliary diaphragm comprises a first fixed portion fixed on the frame, a second fixed portion spaced from the first fixed portion, and a suspension portion connecting the first fixed portion and the second fixed portion, and the flange is fixed to the second fixed portion.

3. The sounding device as described in claim 2, wherein the flange is embedded in the second fixed portion.

4. The sounding device as described in claim 2, wherein the second fixed portion is fixed to one of two opposite sides of the flange along a vibrating direction of the diaphragm.

5. The sounding device as described in claim 1, wherein the diaphragm comprises a first diaphragm body and a second diaphragm body arranged around the first diaphragm body, an outer periphery of the second diaphragm body is fixed to the frame, an inner periphery of the second diaphragm body is fixed to the holder main body, and an outer periphery of the first diaphragm body is fixedly connected to the holder main body and the second connection portion.

6. The sounding device as described in claim 5, wherein the second connection portion comprises a first part fixedly connected to the voice coil and a second part connecting the first part and the holder main body, the first part and the second part are enclosed to form a groove, and the outer periphery of the first diaphragm body comprises a third part fixed to the holder main body and a fourth part fixed to the first part and the second part and filling the groove.

7. The sounding device as described in claim 5, wherein the first diaphragm body has a hollow portion, the magnetic circuit unit comprises a yoke, a main magnet portion fixed to the yoke and an auxiliary magnet portion fixed on one side of the main magnet portion away from the yoke, the auxiliary magnet portion comprises a base portion fixed to the main magnet portion and a boss formed by extending from the base portion to a direction away from the main magnet portion, an orthographic projection of the boss on the base portion is within a range of the base portion, and an inner periphery of the first diaphragm body surrounds the boss and is fixed to the base portion.

8. The sounding device as described in claim 2, wherein the vibration system further comprises a flexible printed circuit board having a retaining portion fixed to the first fixed portion, a bonding portion connected to the second fixed portion, and an elastic arm connecting the retaining portion and the bonding portion, an opening of the suspension portion is oriented toward the flexible printed circuit board, and an orthographic projection of the elastic arm on the auxiliary diaphragm is within a range of the suspension portion.

9. The sounding device as described in claim 8, wherein the flexible printed circuit board further comprises a bending portion formed by bending and extending from the bonding portion to the diaphragm and a first pad portion formed by bending and extending from the bending portion to a direction departing from the bonding portion, the holder main body is provided with a window, and the first pad portion extends into the window and is electrically connected to the voice coil.

* * * * *